US006953001B2

(12) United States Patent
Fanucci et al.

(10) Patent No.: US 6,953,001 B2
(45) Date of Patent: Oct. 11, 2005

(54) HATCH OR DOOR SYSTEM FOR SECURING AND SEALING OPENINGS IN MARINE VESSELS

(75) Inventors: Jerome P. Fanucci, Lexington, MA (US); James J. Gorman, Boxborough, MA (US); Michael McAleenan, Georgetown, ME (US)

(73) Assignee: Kazak Composites, Incorporated, Woburn, MA (US)

( * ) Notice: Subject to any disclaimer, the term of this patent is extended or adjusted under 35 U.S.C. 154(b) by 128 days.

(21) Appl. No.: 10/357,735

(22) Filed: Feb. 4, 2003

(65) Prior Publication Data

US 2003/0213178 A1 Nov. 20, 2003

Related U.S. Application Data

(60) Provisional application No. 60/354,315, filed on Feb. 4, 2002.

(51) Int. Cl.[7] ..... B63B 19/00

(52) U.S. Cl. ..... 114/117; 49/395

(58) Field of Search ..... 114/116, 117, 114/201 R, 203; 49/394, 395; 292/36, 48, 240, 33, 50, 51

(56) References Cited

U.S. PATENT DOCUMENTS

| | | | | | |
|---|---|---|---|---|---|
| 904,275 | A | * | 11/1908 | Peckham | 114/203 |
| 1,364,800 | A | * | 1/1921 | Peterson | 114/203 |
| 2,355,025 | A | * | 8/1944 | Arthur | 114/117 |
| 2,493,882 | A | * | 1/1950 | Lambert | 292/48 |
| 2,493,980 | A | * | 1/1950 | Lambert | 292/48 |
| 2,511,267 | A | * | 6/1950 | Jacob | 114/117 |
| 3,771,485 | A | * | 11/1973 | Brunsell | 114/116 |
| 5,086,587 | A | * | 2/1992 | Andrews | 49/395 |
| 6,341,450 | B1 | * | 1/2002 | Macander et al. | 114/117 |

* cited by examiner

*Primary Examiner*—Lars A. Olson
(74) *Attorney, Agent, or Firm*—Weingarten, Schurgin, Gagnebin & Lebovici LLP

(57) ABSTRACT

A hatch or door system secures and seals an opening in a surrounding structure, such as a horizontal or vertical surface of a marine vessel. A panel having at least two straight edges is rotatably mountable to the surrounding surface. An operating mechanism is mounted on the surrounding structure, rather than on the panel, to retain the panel in the closed position. The operating mechanism includes dogging members configured to apply a force along at least a portion extending continuously along each of the two straight edges when in a panel-securing position. A gasketing mechanism is included to seal the panel in the closed position.

58 Claims, 10 Drawing Sheets

HATCH OR DOOR SYSTEM FOR SECURING AND SEALING OPENINGS IN MARINE VESSELS

CROSS REFERENCE TO RELATED APPLICATIONS

This application claims the benefit under 35 U.S.C. § 119(e) of U.S. Provisional Application No. 60/354,315 filed on Feb. 4, 2002, the disclosure of which is incorporated herein by reference.

STATEMENT REGARDING FEDERALLY SPONSORED RESEARCH OR DEVELOPMENT

The work leading to the invention received support from the United States federal government under SBIR Contract No. N00178-01-C-3026. The federal government may have certain rights in this invention.

BACKGROUND OF THE INVENTION

Ships and other marine vessels include hatches formed in horizontal surfaces and doors formed in vertical surfaces to allow crewmembers and goods to pass through. A hatch or door must be watertight around all of its edges and sufficiently stiff and strong to withstand the forces applied during use. Hatches are typically formed of metal and are heavy to open and close. Thus, a scuttle sized to allow passage of a singe person is typically provided within the hatch. The scuttle must also be watertight. The operating mechanisms to open and close both the hatch and the scuttle are conventionally provided on the hatch itself, adding to the weight.

Hatches and scuttles on ships are traditionally made from steel. During many years of marine service, steel hardware has proven to be relatively inexpensive, to have good resistance to damage from routine operational impacts, to provide inherent EMI and EMP shielding, and to perform well in standard fire tests.

Steel hatches and scuttles have several drawbacks, however. Life cycle costs can be high, due to considerable routine maintenance, such as regular painting to prevent corrosion. Also, the heavy weight makes opening and closing of the hatch and/or scuttle unsafe, particularly in rough weather or in other difficult or dangerous circumstances.

SUMMARY OF THE INVENTION

The present invention provides a lightweight composite material hatch or door system that shifts much of the operating mechanism to open and close the hatch or door from the movable panel to the fixed structure of the ship, which is particularly beneficial in reducing the weight that must be lifted to open or close a hatch panel. By forming the hatch system from a composite material and shifting the operating mechanism off the movable hatch panel, the hatch system is sufficiently reduced in weight to eliminate the need for a separate scuttle within the hatch panel. Routine maintenance needs caused by corrosion are also reduced.

In addition, the operating mechanism of the present invention distributes mechanical point loads associated with dogging the hatch or door panel closed over a much greater percentage of the panel's periphery. The operating mechanism comprises dogging members mounted on the surrounding structure for movement into and out of a panel-securing position. The dogging members can, for example, be mounted for rotation, translation in a direction transversely to the adjacent edge of the panel, or translation in a direction parallel to the adjacent edge of the panel. The dogging members mate with a corresponding configuration on at least two adjacent straight edges of the panel and are configured to apply a force along at least a portion that extends continuously along each of the straight edges when in the panel-securing position. When the dogging members are in the panel-securing position, the panel is secured in the opening and sealed with a gasketing mechanism that surrounds the perimeter of the panel.

DESCRIPTION OF THE DRAWINGS

The invention will be more fully understood from the following detailed description taken in conjunction with the accompanying drawings in which.

DETAILED DESCRIPTION OF THE INVENTION

Regarding a conventional all-metal hatch and scuttle system, both the metal hatch panel and the operating mechanism to open and close the hatch panel and scuttle contribute to the weight of the hatch and scuttle system. The operating mechanism typically provides more than half of the total weight of the hatch system. Thus, the present invention shifts a portion of the operating mechanism off of the movable panel and onto the fixed ship structure. Also, composite materials do not accommodate high point loads as well as the metal structures for which existing hatch operating mechanisms have been designed. The operating mechanism of the present invention better distributes the mechanical point loads associated with securing and sealing the hatch or door closed over a much greater percentage of the composite panel's periphery.

A first embodiment of a hatch or door system of the present invention is illustrated in FIGS. 1–6. The invention is described primarily in terms of a hatch system; however, it will be appreciated that the invention is applicable to a door system as well. The hatch system 10 includes a hatch panel 12, preferably formed of a composite material formed from a fibrous reinforcement impregnated with a matrix material, described further below. The composite material contributes to a significant reduction in weight over that of a conventional all-metal hatch and scuttle system.

Figure 1:
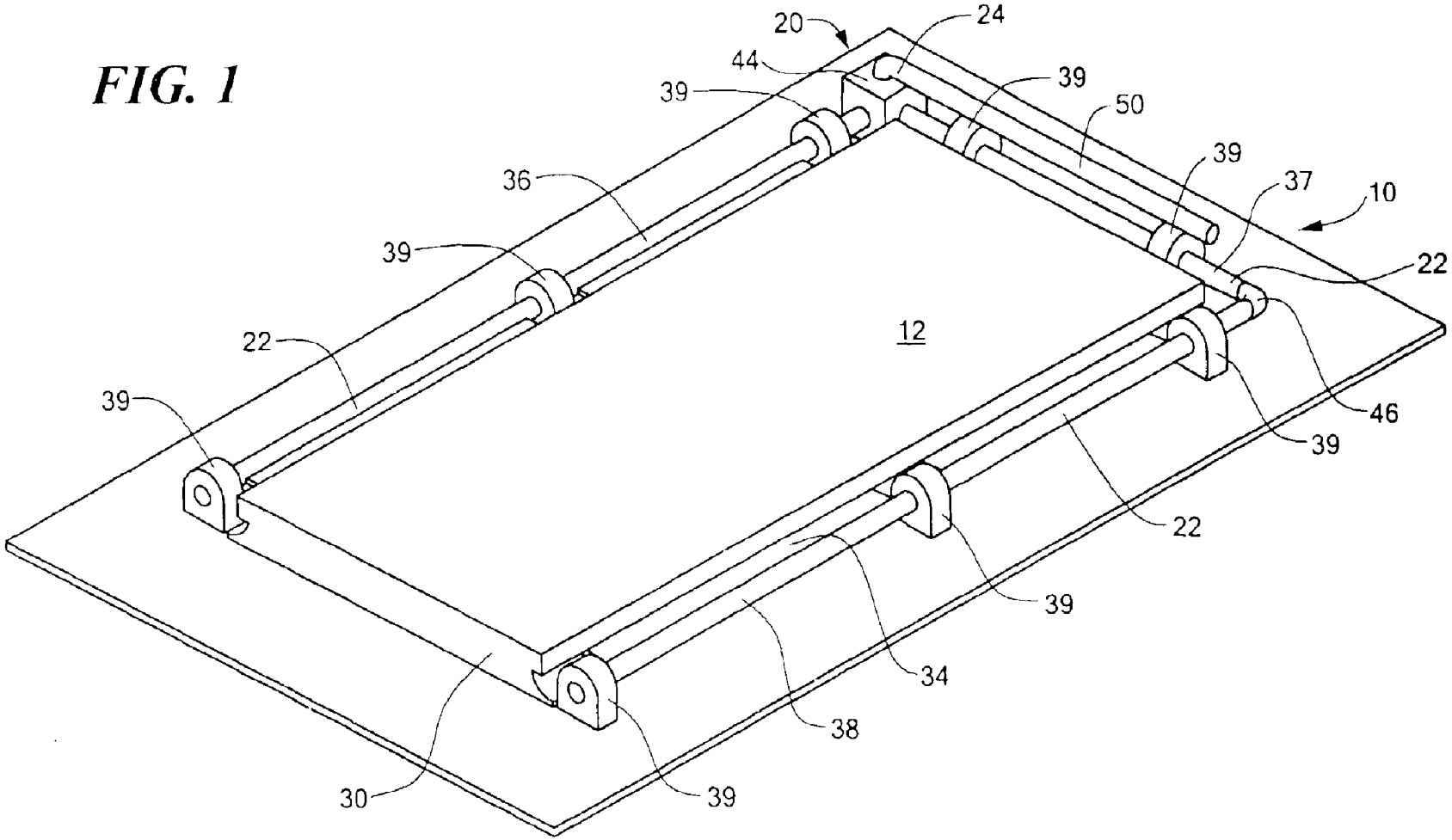
FIG. 1 is an isometric view of a composite hatch system according to the present invention.
Figure 1A:
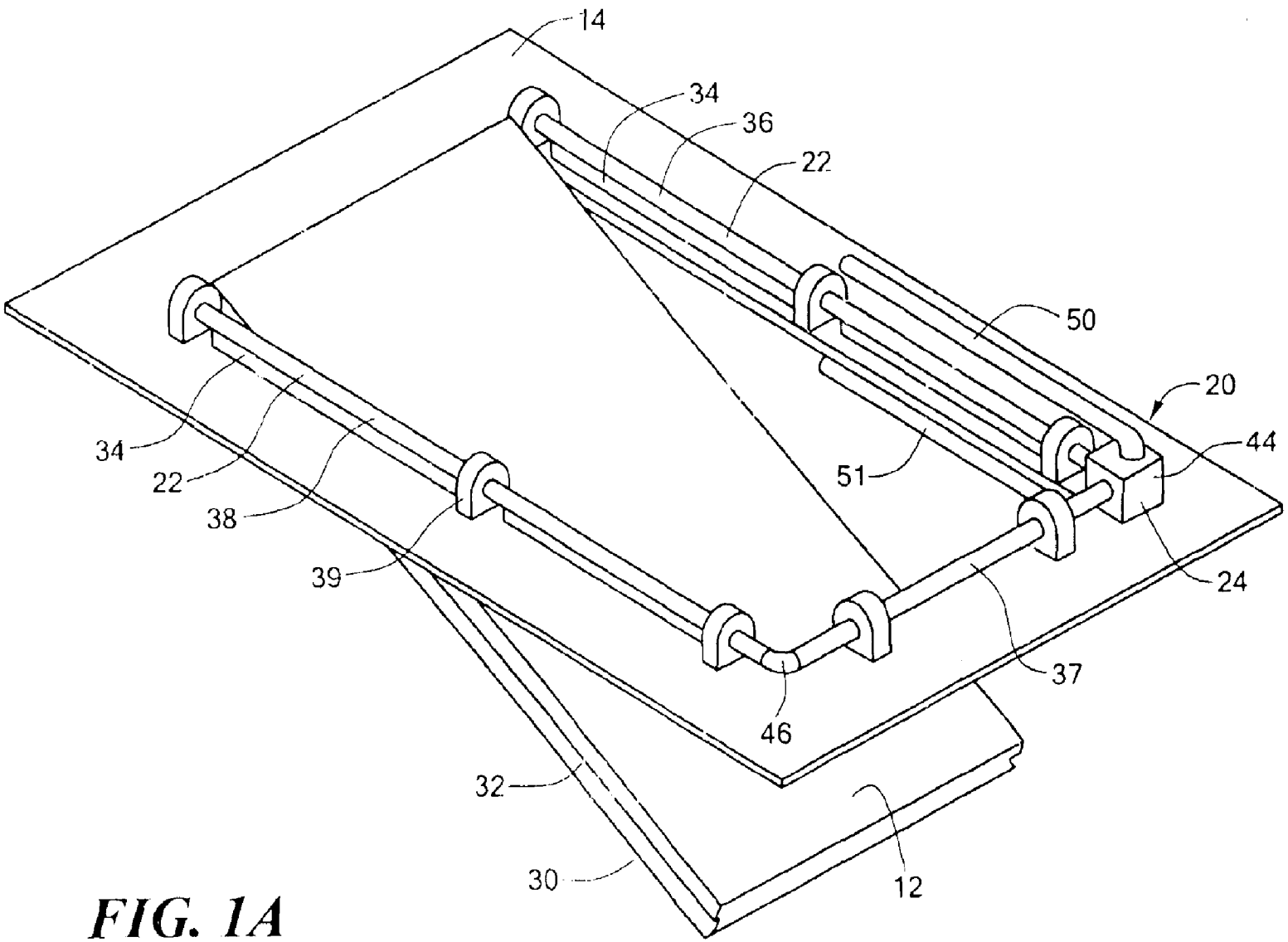
FIG. 1A is an isometric view of the composite hatch system of FIG. 1 in an open position.
Figure 2:
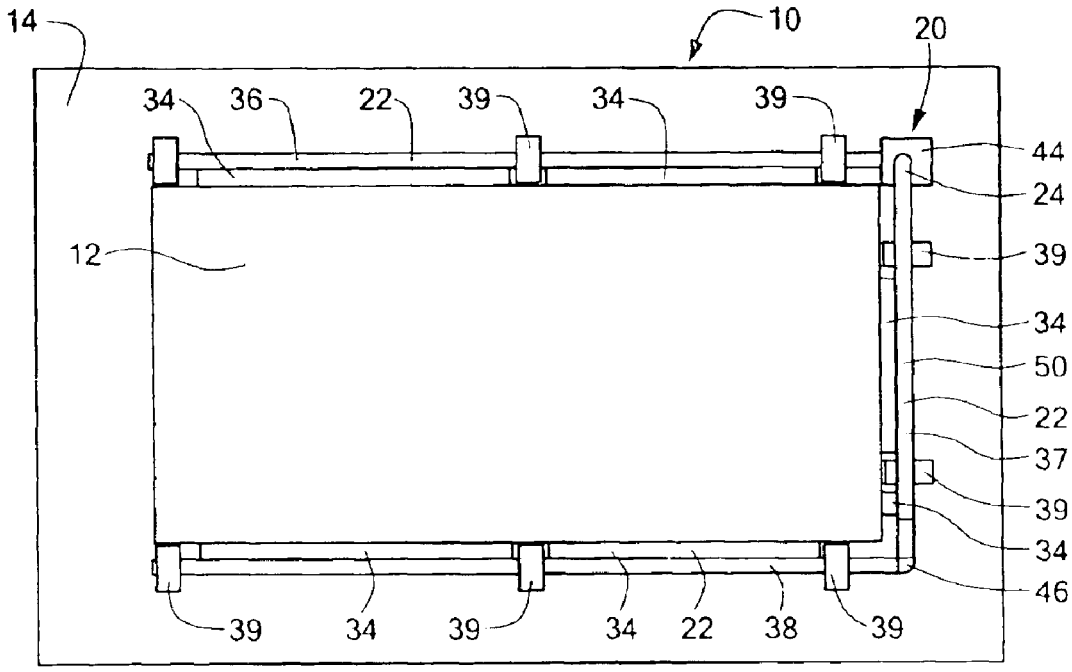
FIG. 2 is a plan view of the hatch system of FIG. 1.
Figure 3:
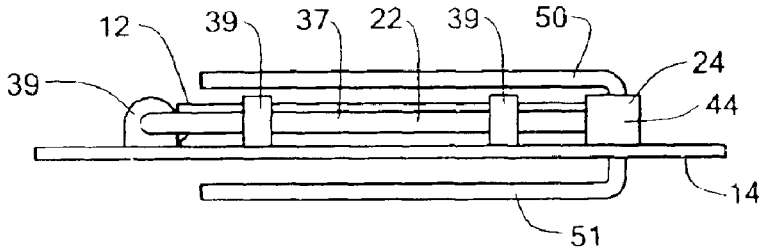
FIG. 3 is a side view of the hatch system of FIG. 1.
Figure 4:
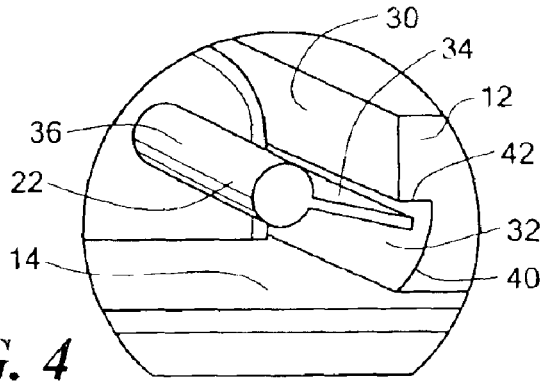
FIG. 4 is a partial isometric detail view of the hatch system of FIG. 1.

The hatch panel is attached at an opening in a fixed surrounding structure 14, such as a bulkhead, deck, or coaming of a ship or other marine vessel, in any suitable manner to allow the hatch panel to be pivoted to an open position. In FIGS. 1, 1A, and 2, appropriate hinges (not shown) are located on the underside of the structure, allowing the panel to be pivoted downwardly. See FIG. 1A.

The hatch system includes an operating mechanism 20 mounted on the surrounding structure 14. The operating mechanism includes one or more dogging members 22 mounted to dog or secure and seal the hatch panel 12 in the closed position. The operating mechanism also includes an actuating mechanism 24 operative to move the dogging members between open and closed positions. The operating mechanism is mounted on the surrounding structure 14 to shift its weight off of the movable hatch panel 12.

The dogging members 22 are configured to mate with the perimeter 30 of the hatch panel in the closed position. The dogging members and the perimeter of the hatch panel are formed with any suitable mating configuration. For example, in FIGS. 1–6, the hatch panel is provided with a recess 32 that extends continuously along at least two and preferably three or four edges of the perimeter, and the dogging members include tangs 34 that fit within the recess 32 to prevent the hatch panel from being rotated into an open position.

As can be seen, the dogging members exert a substantially continuous closing force along the perimeter of the hatch panel. Preferably, at least 40% of the straight sealed edges of the hatch panel is dogged down. In this way, mechanical sealing and securing loads are distributed over a sufficient extent of the perimeter to avoid failures that can arise from high point loads on composite materials. It will be appreciated that the actual perimeter configuration of the hatch panel depends on the particular application. For example, the hatch panel may include radiused or rounded corners, such that a portion of the perimeter is not straight.

In the exemplary embodiment illustrated in FIGS. 1–6, the dogging members include quill shafts 36, 37, 38 that extend along at least two and preferably at least three sides of the hatch panel perimeter. The quill shafts are mounted for rotation on pillow blocks or other support elements 39 fixed to the surrounding structure at various locations about the perimeter of the hatch. The tangs 34 extend radially from each quill shaft 36, 37, 38 continuously along the shafts, except at the locations of the pillow blocks. The tangs fit into the recesses 32 along the perimeter of the panel. The recess includes a curved surface 40 and a flat overhang 42. In the closed position, the tangs 34 abut against the overhang 42 to prevent the panel from being lifted up. Although the overhang 42 is illustrated as a surface parallel to the plane of the panel, it will be appreciated that this surface can be oriented at an angle to the panel's plane. To open the panel, the quill shafts are rotated, which rotates the tangs downwardly, following the curved surface of the recess, until the tangs are clear of the panel. Then, the panel can be rotated downwardly.

The quill shafts are rotated in any suitably manner, such as with handles 50, 51 attached to two adjacent quill shafts 36, 37 via a suitable gear mechanism housed in a gear box 44 at one corner. A double universal 46 joint is provided at the adjacent corner to convert the rotation of the quill shaft 37 to rotation of the quill shaft 38. Similarly, the quill shaft 36 can be extended around the adjacent corner via a second double universal joint (not shown) to actuate dogging mechanisms on the fourth panel edge. The gear mechanism and double universal joint are illustrated schematically in FIGS. 1–3. Suitable gear mechanisms and double universal joints are well known in the art, as would be apparent to those of skill in the art.

Two interconnected handles 50, 51 are provided, one above the panel and one below the panel, so that the panel can be opened or closed from either side. The gearbox 44 is preferably hermetically sealed to prevent leakage of water, as would be known in the art. The handles are rotated in a plane parallel to the panel 12. In the open position, the handles are located in a position clear of the panel so that they do not obstruct opening of the panel.

In the closed position, the hatch panel 12 is sealed to the surrounding structure 14 with any suitable gasketing mechanism. For example, a recess for receiving a gasketing member can be formed adjacent to the perimeter of the hatch panel. In the closed position, the gasketing member abuts against an opposed surface of the surrounding structure. Alternatively, a gasket-receiving recess can be formed in the surrounding structure to abut against an opposed surface of the hatch panel in the closed position. The configuration of the gasketing mechanism is determined by the configuration of the surrounding structure. For example, in some applications, the opening may be surrounded by an upstanding coaming, whereas in other applications the opening may be flush with the surrounding deck.

Figure 5:
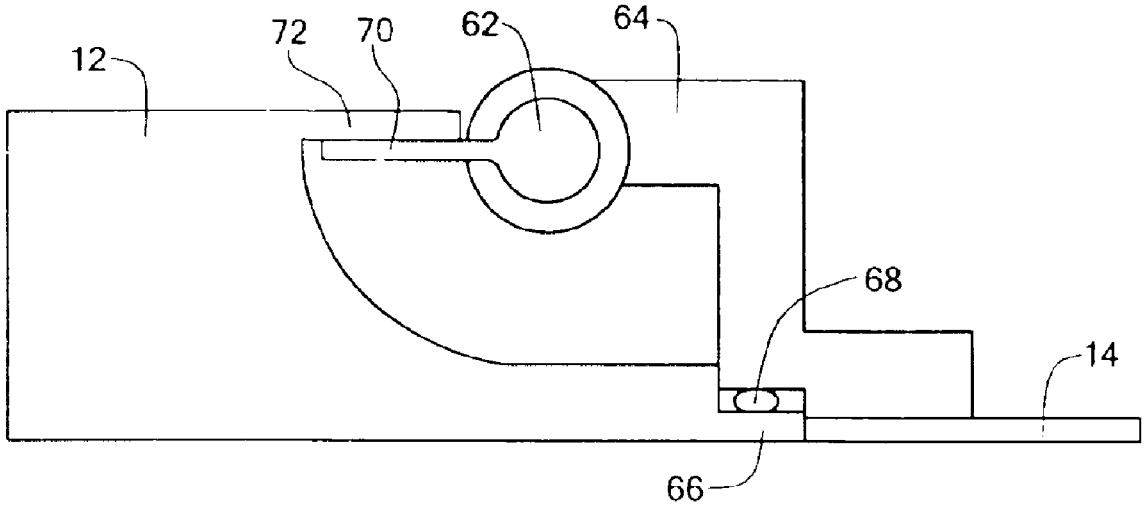
FIG. 5 is a side view of a gasketing mechanism for use with the dogging mechanism of the hatch system of the present invention.
Figure 6:
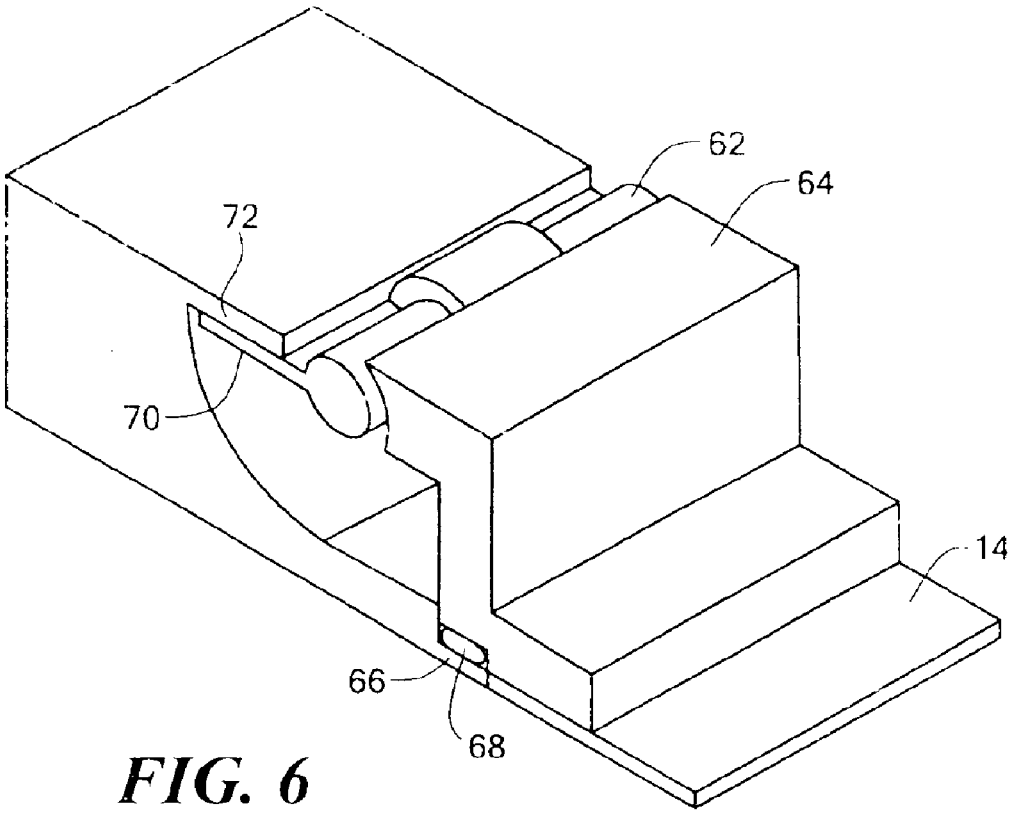
FIG. 6 is an isometric view of the mechanism of FIG. 5.

FIGS. 5 and 6 illustrate with more particularity an example of the gasketing mechanism, in which a quill shaft 62 is mounted to a support block 64, fixed to the surrounding structure 14. The hatch panel 12 includes a flange or lip 66 that extends beneath a portion of the support block, and a gasket seal 68 is interposed between the flange and the support block. In the closed position, the tang 70 on the quill shaft exerts an upward force on the overhang 72 that in turn compresses the panel 12 into the support block 64 at the gasket seal, thereby sealing the panel closed. When the quill shaft is rotated downwardly, the force of the tang on the overhang is relieved and the panel can be opened downwardly. It will be appreciated that the gasketing mechanism illustrated in FIGS. 5 and 6 is suitable for use with the operating mechanism illustrated in FIGS. 1–4, but for clarity has been illustrated separately therefrom. It will also be appreciated that the flange or lip 66 of the panel can extend beneath a portion of the surrounding surface, the gasket seal 68 being interposed between the panel and the surrounding surface.

Figure 7:
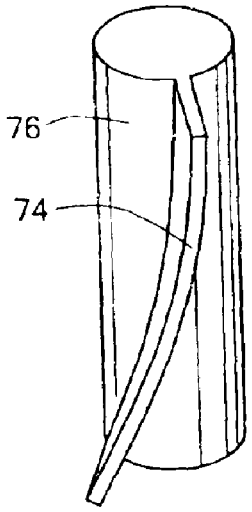
FIG. 7 is a plan view of a further embodiment of a dogging mechanism with a helical tang for use with the hatch system of the present invention.

The quill shafts can twist slightly from the end at the gearbox to the opposite end, such that the tang does not exert a uniform force along the length of the panel. The force exerted at the far end may be less than the force exerted near the gear box. This non-uniformity in force can be compensated by attaching the tang 74 to the quill shaft 76 with a slight helical twist, as illustrated in FIG. 7.

Figure 8:
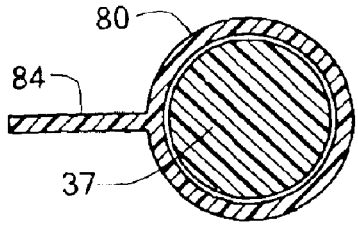
FIG. 8 is an end view of a further embodiment of a dogging mechanism with concentric shafts for use with the hatch system of the present invention.
Figure 8A:
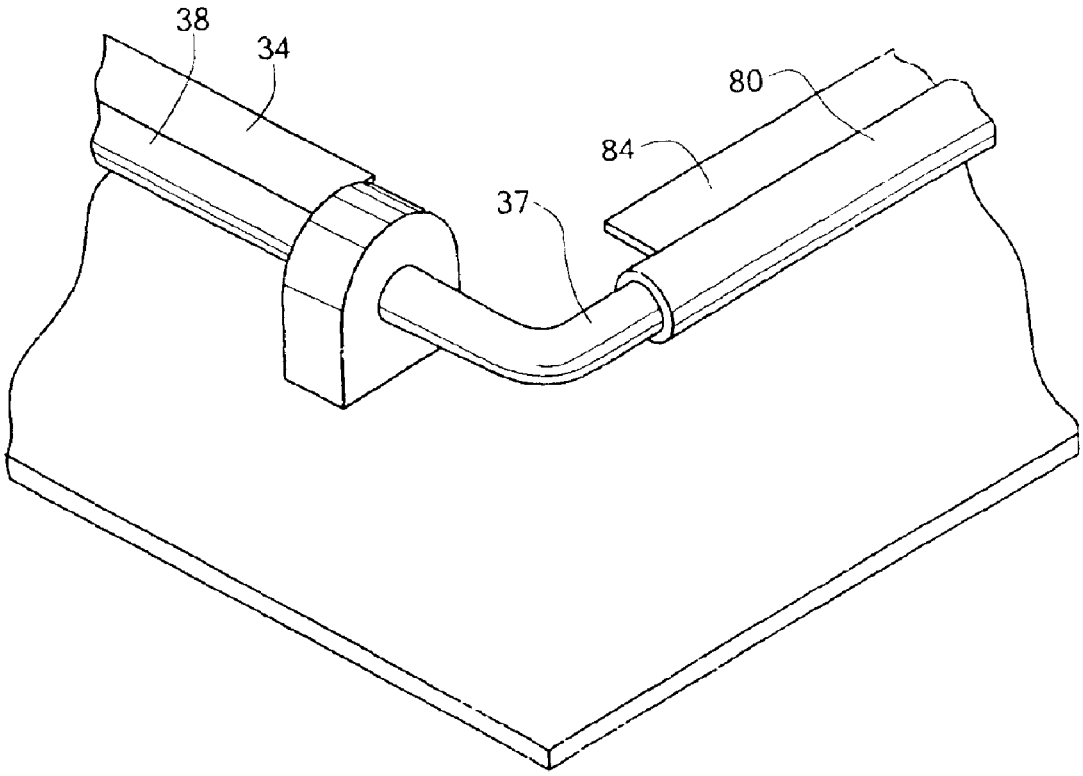
FIG. 8A is a further view of the concentric shafts of FIG. 8.

In an alternative to compensate for the twisting of the quill shaft, an outer shaft 80 can be mounted concentrically surrounding an inner quill shaft such as shaft 37, illustrated in FIG. 8. The tang 84 is attached to the outer shaft 80. The outer shaft is fixed to the inner quill shaft 37 at a location near the gearbox, but remains free of the inner quill shaft for the rest of its length. The outer shaft 80 with attached tang 84 may, for example, terminate at the endpoint of shaft element 37, as indicated in FIG. 8A. In this configuration, the inner shaft continues past the outer shaft on to shaft element 38, with the tang 34 resuming on the uncovered inner shaft, and performing the functions previously described. In this way, the inner shaft may transmit securing and sealing forces to the farther regions of the hatch perimeter through tang 34, unimpeded or undeflected by the forces transmitted to the outer shaft 80 by attached tang 84 in the closer regions of the hatch perimeter. Thus, the combination of inner and outer shafts more uniformly and effectively transmits the hatch securing and sealing forces to the hatch perimeter than would be possible with a single shaft system suffering the tang forces over its entire length.

Figure 9:
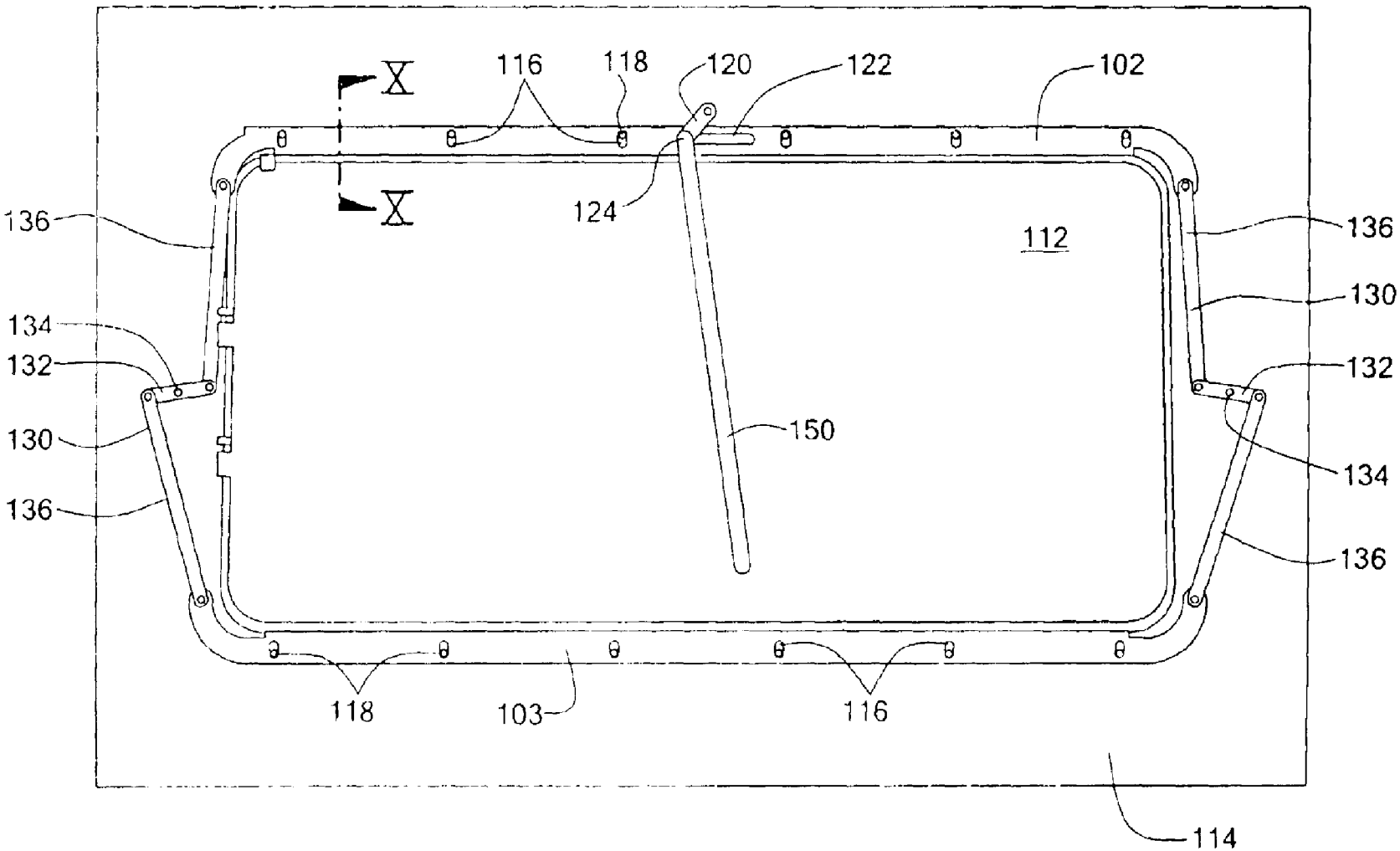
FIG. 9 is a plan view of a further embodiment of a hatch system according to the present invention.
Figure 10:
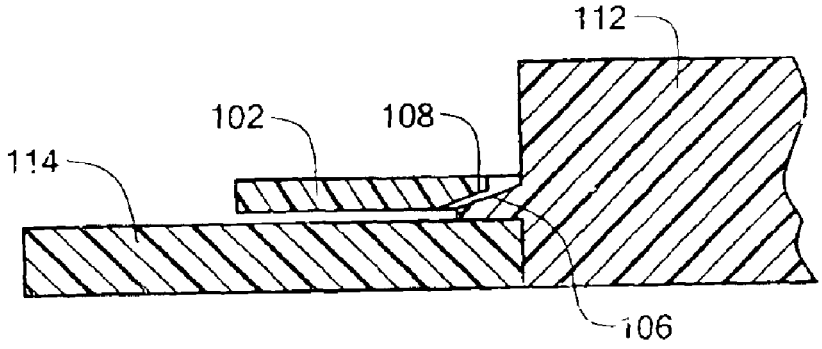
FIG. 10 is a partial sectional view along line X-X of FIG. 9.
Figure 11:
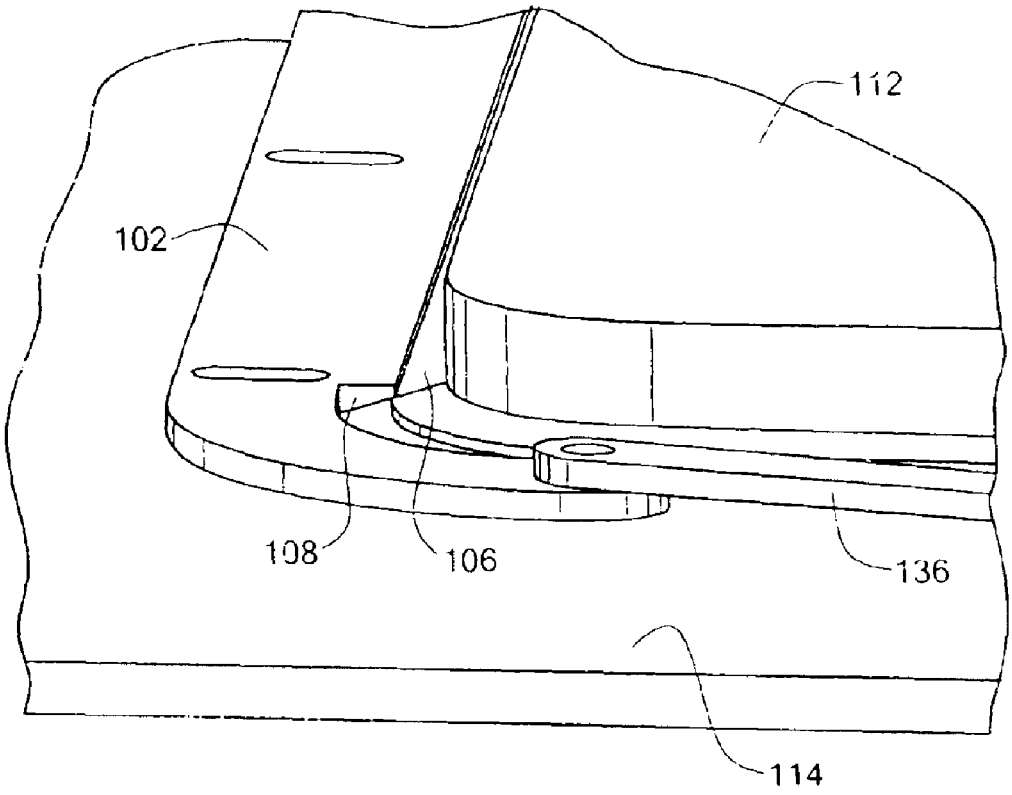
FIG. 11 is a partial isometric detail view of the hatch system of FIG. 9.

Another embodiment of the hatch system is illustrated in FIGS. 9–11. In this embodiment, the dogging members are configured as linkage plates 102, 103 mounted on the surrounding structure 114 to extend along at least two opposed sides 104 of the hatch panel 112. The long edges of the linkage plates are formed with a wedge surface 106 and the opposing long sides of the panel are formed with complementary wedge surfaces 108, as best seen in FIG. 10. In the closed position, the wedge surfaces are brought into contact, sealing the hatch panel closed.

The linkage plates 102, 103 are mounted on the surrounding surface 114 for translation toward and away from the panel 112 in any suitable manner. For example, in the embodiment illustrated, linear guide slots 116 are formed in the linkage plates at suitable intervals. Suitable pins 118 extend from the surrounding structure through the guide slots to ensure linear translation. The actuating mechanism includes a handle 150 mounted to the structure via a pivoting link 120 fixed at one end point to the structure and pinned through a further guide slot 122 in the linkage plate that extends perpendicularly to the linear guide slots. Rotation of the handle causes movement of the pin 124 in the further guide slot 122, thereby moving the linkage plate 102 along the linear guide slots 116 toward or away from the panel 112. Preferably, another handle is attached on the opposite side of the surrounding structure, so that the hatch can be opened from either side.

A linkage 130 connects both linkage plates 102, 103 such that movement of the first linkage plate 102 via the handle 150 causes movement of the other linkage plate 103 in the opposite direction. For example, in the embodiment illustrated, this linkage includes intermediate rotating links 132 fixed for rotation at a midpoint 134 to the surrounding structure 114 at each end of the panel 112. Translating links 136 are pivotally attached to the ends of each rotating link 134. Opposite ends of the translating links are attached to the ends of the linkage plates 102, 103.

Figure 12:
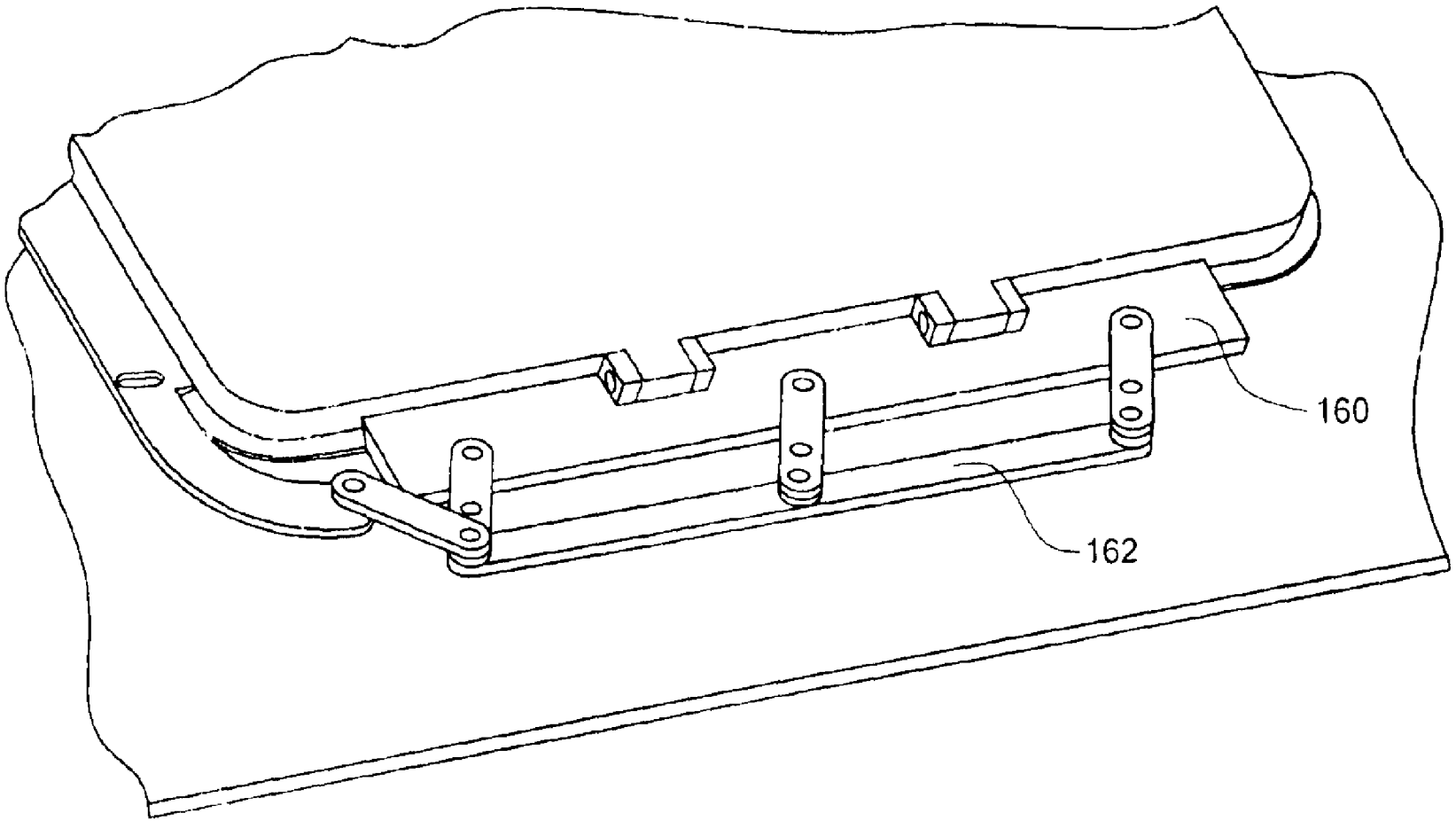
FIG. 12 is a partial view of a further embodiment of a dogging mechanism for use with a hatch system according to the present invention.

The dogging mechanism can also be configured to provide dogging along the corners or along all four sides of the panel. For example, FIG. 12 illustrates an embodiment in which a linkage plate 160 and appropriate connecting linkage mechanism 162 are provided along the shorter edge of the panel to provide additional dogging at this location.

Figure 13:
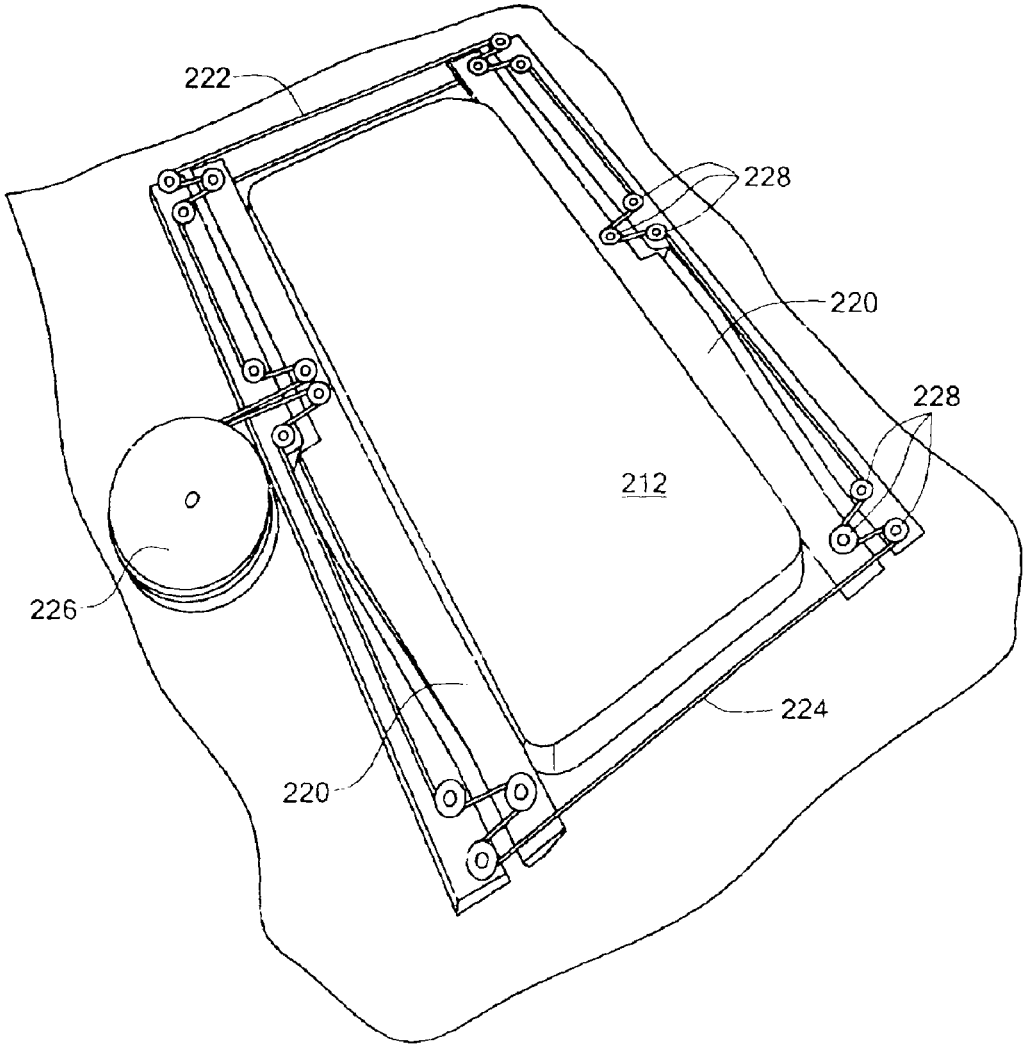
FIG. 13 is an isometric view of a further embodiment of a hatch system according to the present invention.

It will be appreciated that other operating mechanism configurations can be provided. For example, a cable-driven dogging system is illustrated in FIG. 13. A hatch panel 212 is locked into the closed position by dogging members 220 that extend continuously along opposed sides of the hatch panel and include wedge surfaces that interface with corresponding wedge surfaces on the panel, for example, in the manner discussed above. The dogging members are mounted to translate linearly toward and away from the panel. The actuating mechanism includes two closed cable circuits 222, 224 that are wound around a rotatable drum 226 and various sheaves 228 mounted on the surrounding structure and on the dogging members. As the drum is rotated in a first direction, e.g., clockwise, one cable tightens while the other cable slackens, un-dogging the hatch. As the drum is rotated in the opposite direction, e.g., counterclockwise, the first cable slackens while the other cable tightens and the hatch is dogged. Internal to the drum are cable tensioning devices and cable adjustment mechanisms, as would be known in the art.

Figure 14:
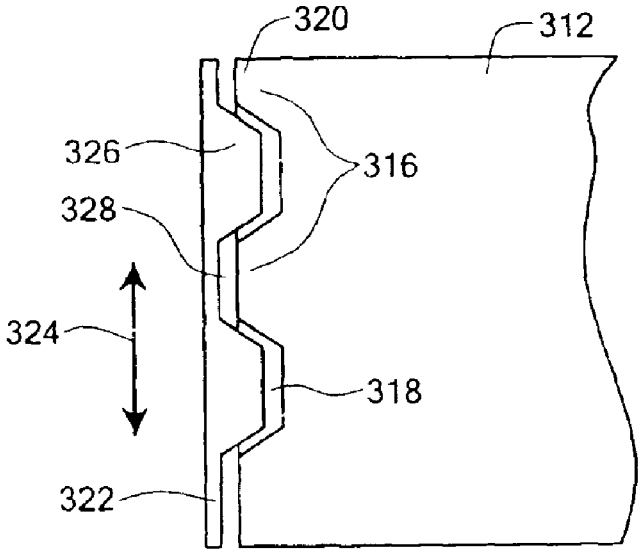
FIG. 14 is a partial plan view of a further embodiment of a hatch system according to the present invention.

In a further exemplary embodiment, a breech-lock-based hatch dogging system is provided, illustrated schematically in FIG. 14. The perimeter of the hatch panel 312 is scalloped with lugs 316 spaced by recesses 318 along at least two opposed sides. The lugs of the scalloped edge are fitted with wedge or wear strips 320 on their upper surfaces. A sliding breech lock 322 is provided along each scalloped edge of the hatch panel, attached to the surrounding structure for translation along its length, parallel to the scalloped edge of the panel in the direction of arrow 324. The breech lock is provided with scalloped lugs 326 and recesses 328 that match those formed into the hatch panel perimeter and include mating wear or wedge strips on their lower surfaces. Translation of the breech lock in one direction causes the lugs of the breech lock to override the lugs of the panel, with the complementary wedge surfaces mating, thereby dogging the hatch panel closed. To open the hatch panel, the breech lock is translated in the opposite direction, decoupling the lugs and allowing the lugs 316 of the hatch panel to pass through the recesses 328 between the lugs on the sliding breech lock. The breech lock may be translated in any suitable manner, such as via a lever-actuated rack and pinion mechanism (not shown) mounted on the surrounding structure.

Further variations on the above embodiments will be apparent to those skilled in the art. For example, the actuating mechanism can be hand-operated or motor-driven. If motor-driven, the actuating mechanism can also be operated remotely. Hydraulic or pneumatic pistons can be provided to operate the dogging members. Such pistons, or other suitable mechanisms, can also provide a positive force to keep the dogging mechanism open or closed, as desired.

By reducing the weight of the bare hatch panel and moving the hatch operating mechanism off of the hatch, the resulting weight that must be lifted can be, in some cases, less than 50 pounds, which is 80 percent less than the weight of many current steel hatch and scuttle combinations. At this lower weight, there is no longer a need for a small scuttle to be incorporated within a larger hatch. Elimination of the scuttle further reduces the weight of the hatch.

Figure 15:
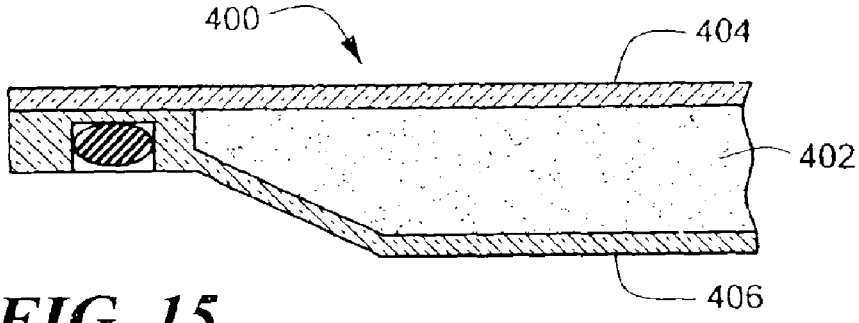
FIG. 15 is a partial cross-sectional view of a sandwich panel for use with a hatch system according to the present invention.

As noted above, the hatch panel is a composite structure. In one embodiment, a sandwich panel is provided. See FIG. 15. The sandwich panel 400 includes a core 402 covered on opposite faces with thinner face sheets or skins 404, 406. The perimeter of the core can be "scarfed" to allow the skins and possibly a perimeter spacer to form a solid laminate edge with sufficient local stiffness and strength to accommodate the hatch securing forces. The actual perimeter configuration depends on the particular application. The perimeter may, for example, include a recess for a sealing gasket.

A sandwich panel can be manufactured in a number of ways, such as with a pultrusion process or a vacuum assisted resin transfer molding process (VARTM). Other process alternatives include resin transfer molding, press molding, pultrusion of subcomponents, filament winding of circular frame sections, and prepreg layup.

The core of a sandwich panel can be of any suitable material, such as a foam material, a matrix filled with lightweight fillers, a honeycomb material, or balsa. The core can be additionally reinforced, for example, with glass yarns extending through the thickness of the core or short fibers dispersed in random or preferentially-oriented arrays throughout the core volume. Other core materials include a carbon foam core, a coal-foam core, or a carbon-felt core. A hybrid core incorporating internal stiffeners can also be used.

The face skins are formed of reinforcing fibers impregnated with a matrix material. The reinforcing fiber may comprise, for example, E-glass in yarn or cloth form, carbon fibers in yarn or cloth, organic fibers including para-aramids and liquid crystal polymers, various inorganic fibers, and metal-coated or otherwise modified fibers. Matrix materials and fiber architectures may furthermore be advantageously modified on a micro-scale by addition of carbon nanotubes. The use of more expensive fibers, such as carbon and metal-coated fibers, can also be limited to areas where increased stiffness is required. Electrically conducting fibers can be used in applications where EMI shielding is desirable.

The choice of matrix material is influenced by factors such as flame and smoke resistance, outgassing of toxic products, particularly products of combustion, mechanical strength and stiffness, impact resistance, and cost and ease of manufacture. Conventional, lower cost thermosetting resin matrix systems include polyesters, vinyl esters and epoxies, which can be modified with additives for improved fire resistance properties. Phenolics, modified acrylics such as MODAR® (available from Ashland, Inc., in Kentucky), bismaleimides and polyimides offer better fire performance than the standard structural thermosets, but are generally less resistant to impact damage and can be more expensive. Thermoplastics such as polyether ether ketone (PEEK) also have good fire performance, but are costly. Phthalonitrile seems to have better fire resistance properties than phenolics, but is far more costly and difficult to process than the more conventional materials cited, limiting its utility for shipboard applications. Polyurethane resins are highly damage resistant, but are more subject to outgassing of toxic products during combustion than the cited alternatives.

A multi-material hybrid composite incorporating layers of different resins can be provided, with outer layers selected for better fire properties and inner layers selected for better mechanical properties.

Figure 16:
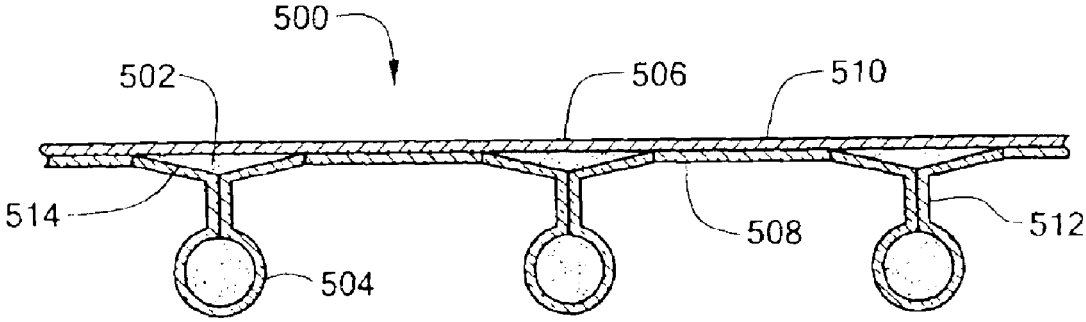
FIG. 16 is a cross-sectional view of an integrally stiffened panel for use with a hatch system according to the present invention.

In another embodiment, an integrally stiffened panel is provided. A compact stiffened panel 500 is illustrated in FIG. 16. This panel incorporates integral stiffeners 502, 504 extending across a panel. This panel has skin material 506, 508 surrounding the upper longitudinal reinforcements 502 and the stiffener bulb reinforcements 504. The skin material forms the upper panel 510 as well as the flanges 512 of the stiffening elements. The materials for the skin, upper reinforcements and bulb reinforcements can be different. The panel skin can be thickened near the stiffener root 514 to reduce the sensitivity of the stiffeners to delamination from the skin.

The dogging members of the operating mechanism can be manufactured from any suitable materials, such as metal or composite materials. They may be machined from stock or molded to shape as best suits particular applications.

The movable hatch panel, in either sandwich form or integrally stiffened form, and the dogging members can be produced using a variety of composite manufacturing processes. Suitable composite manufacturing processes include press molding, vacuum-assisted resin transfer molding, pultrusion, hand layup and autoclave processing, and tow or tape placement.

In an uncluttered environment, with broad expanses of uninterrupted panel surfaces (such as interior doors and very large hatches), sandwich designs offer weight and cost advantages over uncored, integrally-stiffened panels built up from a combination of discrete stiffeners, frames and skins. Sandwich panels also offer an advantage when exposed to fire, since the surface laminate's resin can char but still retain some integrity from the remaining unburned surface fibers and cooler back surface fibers. The fiber-reinforced surface char layer can help to support a more or less intact core, continue to restrict heat transfer through the panel, and provide some residual structural stability. In normal service, sandwich panels provide better thermal and sound insulation than integrally stiffened designs.

The thin face skins of sandwich panels are prone to impact and penetration damage. Integrally stiffened panels are generally more resistant to impact damage and to point loads. Such panels are also better suited to designs incorporating greater detail. The specific choice of sandwich versus integrally-stiffened panel therefore depends upon application-specific tradeoffs.

A tread surface may be overlaid on the panel. The tread surface may be a non-skid surface for safety and/or a fire retardant coating. Fire retardant barriers can be applied to the panels, particularly as an alternative to selecting fire resistant resins. Use of such a barrier enables resins with lesser fire resistant properties to be used for the bulk of the composite structure. Fire retardant barriers include coatings, such as CHARTEK, that can be painted or sprayed on after the hatch is manufactured. Other materials, in the form of films or sheet stock, can be cut to size and either co-molded with the part or applied later in a secondary operation. In an alternative embodiment, the panel can be pultruded with an edge detail configured to hold a bead of intumescent fire resistant material that, when exposed to fire, expands to fill the gap between the hatch and the adjoining structure.

EMI or EMP shielding can also be provided by a metal mesh or perforated metal foil layered into the laminate. The continuation of the shield integrity between the composite panel and the metal ship structure can include an interface between the hatch and the ship deck that takes advantage of wave-guide to cut-off geometries. Alternatively, conductive gasketing, metal interlocking fingers, or other conductive seals at the interfaces metal can be provided.

While described in conjunction with a ship or other marine vessel, the hatch or door system of the present invention can be employed in other situations where the hatch system would be useful, such as in openings to provide access to building roofs or in aircraft. Similarly, although the panel is described as being formed of a composite material, it will be appreciated that the various embodiments of the operating mechanism mounted on the surrounding structure are also operable in conjunction with a metal panel. The invention is not to be limited by what has been particularly shown and described, except as indicated by the appended claims.

What is claimed is:

1. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel; and an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position, the dogging members providing forces along at least 40% of straight edges of the panel.

2. The system of claim 1, wherein each of the dogging members is mounted on the surrounding structure for rotation about an axis parallel to an adjacent edge of the panel.

3. The system of claim 1, wherein each of the dogging members is mounted for translation toward and away from an adjacent edge of the panel in a direction transverse to the adjacent edge of the panel.

4. The system of claim 1, wherein each of the dogging members is mounted for translation parallel to an adjacent edge of the panel.

5. The system of claim 1, wherein each continuously extending portion of the panel is formed with a recess and each dogging member is formed with a complementary configuration matable with the recess.

6. The system of claim 5, wherein the recess is formed by a curved surf ace and a flat face, and the dogging members each comprise a protrusion rotatably mounted on a shaft for rotation following the curved surface into the panel-securing position abutting the flat face.

7. The system of claim 6 wherein the dogging members comprise a quill shaft mounted for rotation and the protrusion comprises a tang extending radially from the quill shaft.

8. The system of claim 7, wherein the tang extends along the length of the quill shaft in a helical configuration.

9. The system of claim 6, wherein the dogging members include an inner quill shaft and an outer quill shaft, the outer quill shaft attached to the inner quill shaft at one end and terminating at a location spaced from an end of the inner quill shaft, a tang extending from the outer quill shaft, and a further tang extending from the inner quill shaft along a portion of the inner quill shaft beyond the termination of the outer quill shaft.

10. The system of claim 6, wherein the operating mechanism comprises an actuating mechanism operative to rotate the shaft, the actuating mechanism including a handle configured for gripping by an operator.

11. The system of claim 10, wherein the actuating mechanism further comprises a second handle on an opposite side of the surrounding structure, whereby the operating mechanism is operable from either side of the surrounding structure.

12. The system of claim 11, wherein the handle and second handle are connected through the surrounding structure via a sealed gearbox.

13. The system of claim 6, wherein the shafts of the operating mechanism extend in at least two orthogonal directions along adjacent sides of the panel, and the actuating mechanism includes a gearing mechanism operative to rotate each shaft about its axis.

14. The system of claim 13, wherein the operating mechanism includes a third shaft connected at a double universal joint to an adjacent shaft to extend orthogonally from the adjacent connected shaft, the double universal joint transferring rotation from the adjacent shaft to the third shaft to cause rotation of the third shaft about its axis.

15. The system of claim 1, further comprising a lip formed on the panel to extend beneath an opposing surface, a gasketing member disposed between the lip and the opposing surface.

16. The system of claim 15, wherein the opposing surface is formed on a portion of the operating mechanism.

17. The system of claim 15, wherein the opposing surface is formed on a portion of the surrounding structure.

18. The system of claim 1, further comprising a gasketing mechanism disposed to seal the panel within the opening in the closed position.

19. The system of claim 1, wherein the dogging members comprise linkage plates mounted on the surrounding structure for translation toward and away from the panel, long edges of each linkage plate configured with a wedge surface, opposing edges of the panel configured with complementary wedge surfaces, whereby in a panel-securing position, the wedge surfaces and complementary wedges surfaces are contacting.

20. The system of claim 19, further comprising an actuating mechanism operative to effect translation of the linkage plates, the actuating mechanism including a handle operatively connected to one of the linkage plates, and an interconnecting linkage connected between the linkage plates.

21. The system of claim 20, wherein the interconnecting linkage comprises a rotating link rotatably fixed to the surrounding structure, and a pair of translating links connected between ends of the rotating link and associated ones of the linkage plates.

22. The system of claim 19, further comprising a cable-driven actuating mechanism operative to effect translation of the linkage plates.

23. The system of claim 22, wherein the cable-driven actuating mechanism comprises an opening cable circuit arid a closing cable circuit, the cable circuits each comprising a cable wound around sheaves disposed on the surrounding structure and the linkage plates in a configuration to effect translation of the linkage plates.

24. The system of claim 1, wherein the dogging members comprises breech lock members mountable on the surrounding structure for translation parallel to the two straight edges, the straight edges including recesses formed therein to define protruding lugs, the breech lock members including complementary recesses and lugs, the lugs having opposed wedge surfaces, whereby in a panel-securing position, the wedge surfaces are in contact, and in an open position, the lugs of the panel are passable through the recesses of the breech lock members.

25. The system of claim 1, wherein the dogging members are disposed on the surrounding structure adjacent at least three sides of the panel.

26. The system of claim 1, wherein the dogging members are disposed on the surrounding structure adjacent at least four sides of the panel.

27. The system of claim 1, wherein the dogging members are disposed on the surrounding structure adjacent corners of the panel.

28. The system of claim 1, wherein the dogging members exert a substantially continuous force along the perimeter of the panel sufficient to avoid failure from high point loads.

29. The system of claim 1, wherein the operating mechanism includes an actuating mechanism operable by hand.

30. The system of claim 1, wherein the operating mechanism includes an actuating mechanism operable by power.

31. The system of claim 1, wherein the actuating mechanism is operable remotely.

32. The system of claim 1, wherein the panel has a sandwich panel configuration comprising a core covered on opposite faces with face skins.

33. The system of claim 1, wherein the panel comprises stiffeners integrated within surrounding skin material.

34. The system of claim 1, wherein the panel is mounted horizontally in the surrounding structure.

35. The system of claim 1, wherein the panel is mounted vertically in the surrounding structure.

36. The system of claim 1, wherein the panel is mounted in the surrounding structure of a marine vessel.

37. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a cloned position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position; and wherein each of the dogging members is mounted on the surrounding structure for rotation about an axis parallel to an adjacent edge of the panel.

38. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position; and wherein each of the dogging members is mounted for translation toward and away from an adjacent edge of the panel in a direction transverse to the adjacent edge of the panel.

39. A hatch or door system for closing en opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position;

wherein each continuously extending portion of the panel is formed with a recess and each dogging member is formed with a complementary configuration matable with the recess;

wherein the recess is formed by a curved surface and a flat face, and the dogging members each comprise a protrusion rotatably mounted on a shaft for rotation following the curved surface into the panel-securing position abutting the flat face; and wherein the dogging members comprise a quill shaft mounted for rotation and the protrusion comprises a tang extending radially from the quill shaft.

40. The system of claim 39, wherein the tang extends along the length of the quill shaft in a helical configuration.

41. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position;

wherein each continuously extending portion of the panel is formed with a recess and each dogging member is formed with a complementary configuration matable with the recess;

wherein the recess is formed by a curved surface and a flat face, and the dogging members each comprise a protrusion rotatably mounted on a shaft for rotation following the curved surface into the panel-securing position abutting the flat face; and wherein the dogging members include an inner quill shaft and an outer quill shaft, the outer quill shaft attached to the inner quill shaft at one end and terminating at a location spaced from an end of the inner quill shaft, a tang extending from the outer quill shaft, and a further tang extending from the inner quill shaft along a portion of the inner quill shaft beyond the termination of the outer quill shaft.

42. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position;

wherein each continuously extending portion of the panel is formed with a recess and each dogging member is formed with a complementary configuration matable with the recess;

wherein the recess is formed by a curved surface and a flat face, and the dogging members each comprise a protrusion rotatably mounted on a shaft for rotation following the curved surface into the panel-securing position abutting the flat face;

wherein the operating mechanism comprises an actuating mechanism operative to rotate the shaft, the actuating mechanism including a handle configured for gripping by an operator;

wherein the actuating mechanism further comprises a second handle on an opposite side of the surrounding structure, whereby the operating mechanism is operable from either side of the surrounding structure; and wherein the handle and the second handle are connected through the surrounding structure via a sealed gearbox.

43. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position;

wherein each continuously extending portion of the panel is formed with a recess and each dogging member is formed with a complementary configuration matable with the recess;

wherein the recess is formed by a curved surface and a flat face, and the dogging members each comprise a protrusion rotatably mounted on a shaft for rotation following the curved surface into the panel-securing position abutting the flat face; and wherein the shafts of the operating mechanism extend in at least two orthogonal directions along adjacent sides of the panel, and the actuating mechanism includes a gearing mechanism operative to rotate each shaft about its axis.

44. The system of claim 43, wherein the operating mechanism includes a third shaft connected at a double universal joint to an adjacent shaft to extend orthogonally from the adjacent connected shaft, the double universal joint transferring rotation from the adjacent shaft to the third shaft to cause rotation of the third shaft about its axis.

45. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position;

further comprising a lip formed on the panel to extend beneath an opposing surface, a gasketing member disposed between the lip and the opposing surface; and wherein the opposing surface is formed on a portion of the operating mechanism.

46. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position; and wherein the dogging members comprise linkage plates mounted on the surrounding structure for translation toward and away from the panel, long edges of each linkage plate configured with a wedge surface, opposing edges of the panel configured with complementary wedge surfaces, whereby in a panel-securing position, the wedge surfaces and complementary wedge surfaces are contacting.

47. The system of claim 46, further comprising an actuating mechanism operative to effect translation of the linkage plates, the actuating mechanism including a handle operatively connected to one of the linkage plates, and an interconnecting linkage connected between the linkage plates.

48. The system of claim 47, wherein the interconnecting linkage comprises a rotating link rotatably fixed to the surrounding structure, and a pair of translating links connected between ends of the rotating link and associated ones of the linkage plates.

49. The system of claim 46, further comprising a cable-driven actuating mechanism operative to effect translation of the linkage plates.

50. The system of claim 49, wherein the cable-driven actuating mechanism comprises an opening cable circuit and a closing cable circuit, the cable circuits each comprising a cable wound around sheaves disposed on the surrounding structure and the linkage plates in a configuration to effect translation of the linkage plates.

51. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position; and wherein the dogging members comprise breech lock members mountable on the surrounding structure for translation parallel to the two straight edges, the straight edges including recesses formed therein to define protruding lugs, the breech lock members including complementary recesses and lugs, the lugs having opposed wedge surfaces, whereby in a panel-securing position, the wedge surfaces are in contact, and in an open position, the lugs of the panel are passable through the recesses of the breech lock members.

52. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position; and wherein the panel has a sandwich panel configuration comprising a core covered on opposite faces with face skins.

53. A hatch or door system for closing an opening in a surrounding structure, comprising:

a panel configured to close the opening in the surrounding structure;

the panel having a configuration having at least two straight edges disposed along opposite sides of the panel;

the panel rotatably mountable to the surrounding structure for rotation between a closed position and an open position, wherein in the closed position, the opening in the surrounding structure is closed by the panel;

an operating mechanism for retaining the panel in the closed position, the operating mechanism comprising dogging members movably mountable on the surrounding structure at a location adjacent at least the two straight edges of the panel and configured to apply a force along at least a portion extending continuously along each of the two straight edges when in a panel-securing position; and wherein the panel comprises stiffeners integrated within surrounding akin material.

54. The system of claims 37, 38, 39, 41, 42, 43, 45, 46, 51, 52, or 53, wherein the dogging members exert a substantially continuous force along the perimeter of the panel sufficient to avoid failure from high point loads.

55. The system of claims 37, 38, 39, 41, 42, 43, 45, 46, 51, 52, or 53, wherein the dogging members provide forces along at least 40% of straight sealed edges of the panel.

56. The system of claims 1, 37, 38, 39, 41, 42, 43, 45, 46, 51, 52, or 53, wherein the panel is formed of a metal material.

57. The system of claims 37, 38, 39, 41, 42, 43, 49, 46, 51, 52, or 53, wherein the panel is mounted in the surrounding structure of a marine vessel.

58. The system of claims 1, 37, 38, 39, 41, 42, 43, 45, 46, 51, 52, or 53, wherein the panel is formed of a composite material comprising a fibrous, reinforcement impregnated with a matrix material.

* * * * *

UNITED STATES PATENT AND TRADEMARK OFFICE

CERTIFICATE OF CORRECTION

PATENT NO. : 6,953,001 B2
APPLICATION NO. : 10/357735
DATED : October 11, 2005
INVENTOR(S) : Jerome P. Fanucci et al.

It is certified that error appears in the above-identified patent and that said Letters Patent is hereby corrected as shown below:

Title Page, (75) Inventors, add --Robert A. DaSilva, Lowell, MA (US)--;

Column 9, claim 6, line 45, “surf ace” should read --surface--;

Column 10, claim 23, line 51, “arid” should read --and--;

Column 11, claim 37, line 34, “cloned” should read --closed--;

Column 12, claim 39, line 5, “en” should read --an--;

Column 16, claim 53, line 42, “akin” should read --skin--; and

Column 16, claim 57, line 53, “49” should read --45--.

Signed and Sealed this

Twelfth Day of December, 2006

JON W. DUDAS
*Director of the United States Patent and Trademark Office*